US005340346A

United States Patent [19]

Muzeroll

[11] Patent Number: 5,340,346

[45] Date of Patent: Aug. 23, 1994

[54] DOUBLE-ENDED METAL HALIDE ARC DISCHARGE LAMP WITH ELECTRICALLY ISOLATED CONTAINMENT SHROUD

[75] Inventor: Martin M. Muzeroll, Merrimack, N.H.

[73] Assignee: Osram Sylvania Inc., Danvers, Mass.

[21] Appl. No.: 169,698

[22] Filed: Dec. 20, 1993

Related U.S. Application Data

[62] Division of Ser. No. 866,381, Apr. 10, 1992, Pat. No. 5,296,779.

[51] Int. Cl.[5] ..... H01J 9/26

[52] U.S. Cl. ..... 445/26; 445/44

[58] Field of Search ..... 445/26, 44

[56] References Cited

U.S. PATENT DOCUMENTS 4,580,989 4/1986 Fohl et al. ..... 445/26

4,620,125 10/1986 Keeffe et al. ..... 313/25

FOREIGN PATENT DOCUMENTS 59-194339 11/1984 Japan ..... 445/26

*Primary Examiner*—P. Austin Bradley

*Assistant Examiner*—Jeffrey T. Knapp

*Attorney, Agent, or Firm*—William H. McNeill

[57] ABSTRACT

A double-ended arc discharge lamp includes a sealed, light-transmissive outer jacket, a light-transmissive shroud mounted within the outer jacket and directly supported by the outer jacket, and an arc discharge tube mounted within the shroud. The arc tube is typically a metal halide arc discharge tube. In a preferred embodiment, the shroud includes an outwardly flared portion at each end. The outwardly flared portions space the shroud from the outer jacket and support the shroud within the outer jacket. The outwardly flared portions of the shroud can be affixed to the outer jacket by fusing. The outer jacket can be provided with inwardly extending dimples for locating the shroud with respect to the outer jacket. In another embodiment, the outer jacket includes reduced diameter portions near each end which are attached to the shroud.

2 Claims, 3 Drawing Sheets

DOUBLE-ENDED METAL HALIDE ARC DISCHARGE LAMP WITH ELECTRICALLY ISOLATED CONTAINMENT SHROUD

GOVERNMENT RIGHTS

The Government may have rights in this invention pursuant to Contract No. NAS9-18200 awarded by NASA.

This is a division of copending application Ser. No. 07/866,381, filed on Apr. 10, 1992, now U.S. Pat. No. 5,296,779.

FIELD OF THE INVENTION

This invention relates to metal halide arc discharge lamps and, more particularly, to double-ended metal halide arc discharge lamps which include a light-transmissive shroud. The shroud improves lamp performance and acts as a containment device in the event that the arc tube shatters.

BACKGROUND OF THE INVENTION

Metal halide arc discharge lamps are frequently employed in commercial usage because of their high luminous efficacy and long life. A typical metal halide arc discharge lamp includes a quartz or fused silica arc tube that is hermetically sealed within an outer jacket or envelope. The arc tube, itself hermetically sealed, has tungsten electrodes mounted therein and contains a fill material including mercury, metal halide additives and a rare gas to facilitate starting. In some cases, particularly in high wattage lamps, the outer envelope is filled with nitrogen or another inert gas at less than atmospheric pressure. In other cases, particularly in low wattage lamps, the outer envelope is evacuated.

It has been found desirable to provide metal halide arc discharge lamps with a shroud which comprises a generally cylindrical light-transmissive member, such as quartz, that is able to withstand high operating temperatures. The arc tube and the shroud are coaxially mounted within the lamp envelope with the arc tube located within the shroud. Preferably, the shroud is a tube that is open at both ends. In other cases the shroud is open on one end and has a domed configuration on the other end. Shrouds for metal halide arc discharge lamps are disclosed in U.S. Pat. No. 4,499,396 issued Feb. 12, 1985 to Fohl et al.; U.S. Pat. No. 4,620,125 issued Oct. 28, 1986 to Keeffe et al; U.S. Pat. No. 4,625,141 issued Nov. 25, 1986 to Keeffe et al; U.S. Pat. No. 4,580,989 issued Apr. 8, 1986 to Fohl et al.; U.S. Pat. No. 4,709,184 issued Nov. 24, 1987 to Keeffe et al.; U.S. Pat. No. 4,721,876 issued Jan. 26, 1988 to White et al.; U.S. Pat. No. 4,791,334 issued Dec. 13, 1988 to Keeffe et al.; U.S. Pat. No. 4,888,517 issued Dec. 19, 1989 to Keeffe et al.; and U.S. Pat. No. 5,023,505 issued Jun. 11, 1991 to Ratliff et al. See also U.S. Pat. No. 4,281,274 issued Jul. 28, 1981 to Beehard et al.

The shroud has several beneficial effects on lamp operation. In lamps with a gas-filled outer envelope, the shroud reduces convective heat losses from the arc tube and thereby improves the luminous output and the color temperature of the lamp. In lamps with an evacuated outer envelope, the shroud helps to equalize the temperature of the arc tube. In addition, the shroud effectively reduces sodium losses from the arc tube and improves the maintenance of phosphor efficiency in metal halide lamps having a phosphor coating on the inside surface of the outer envelope. Finally, the shroud improves the safety of the lamp by acting as a containment device in the event that the arc tube shatters.

All of the known prior art metal halide lamps which utilize a shroud are single-ended with respect to mounting and application of electrical energy to the arc tube. The shroud is held in position within the lamp envelope by attaching it to a metal frame which extends between the ends of the lamp envelope. Metal clips or straps attached to the ends of the shroud are welded to the frame.

Double-ended metal halide lamps have been developed for low wattage and other special applications. The arc tube is mounted within a light-transmissive outer jacket and the ends of the outer jacket are press-sealed, with the arc tube electrical leads extending through the press seals. The lamp is mechanically supported at both ends, and electrical energy is applied to opposite ends of the lamp. It is desirable to use a light-transmissive shroud in a double-ended metal halide lamp to provide one or more of the advantages described above. However, the shroud mounting techniques used in prior art single-ended lamps may not be suitable for use in double-ended lamps. In double-ended lamps, the space between the outer jacket and the arc tube is very limited. In addition, these lamps operate at high temperatures. There may be insufficient space to mount the shroud using a metal frame and clips or straps. Even if metal mounting elements could be utilized, it is likely that they would be subject to fatigue in the high operating temperatures of double-ended metal halide lamps.

It is a general object of the present invention to provide improved metal halide arc discharge lamps.

It is another object of the present invention to provide double-ended arc discharge lamps having a light-transmissive shroud between the arc tube and the outer jacket.

It is another object of the present invention to provide double-ended arc discharge lamps which can be safely operated without a protective fixture.

It is yet another object of the present invention to provide double-ended metal halide arc discharge lamps which have a high luminous output and a long operating life.

It is yet another object of the present invention to provide double-ended metal halide arc discharge lamps which are small in physical size.

It is a further object of the present invention to provide double-ended metal halide arc discharge lamps which are low in cost and are easily manufactured.

SUMMARY OF THE INVENTION

According to the present invention, these and other objects and advantages are achieved in a double-ended arc discharge lamp comprising a sealed light-transmissive outer jacket, a light-transmissive shroud disposed within the outer jacket and directly supported by the outer jacket, an arc discharge tube disposed within the shroud, and means for coupling electrical energy through opposite ends of the outer jacket to the arc discharge tube. The shroud is typically tubular in shape and is supported at its ends by the outer jacket.

In a preferred embodiment, the shroud includes an outwardly flared portion at each end. The outwardly flared portions space the shroud from the outer jacket and support the shroud within the outer jacket. The outwardly flared portions of the shroud can be affixed to the outer jacket by fusing. The outer jacket can include one or more inwardly extending dimples for locating the shroud with respect to the outer jacket. The outer jacket is typically tubular in shape.

The space between the outer jacket and the shroud is preferably interconnected with the interior of the shroud. This permits the space between the outer jacket and the shroud to be cleaned after processing and also ensures equalization of pressures on the inner and outer surfaces of the shroud during operation. Preferably, the flared portions of the shroud have notches or other openings to provide access to the space between the shroud and the outer jacket.

In an alternative embodiment, the flared portions of the shroud are omitted, and the outer jacket includes reduced diameter portions near each end which are attached to the shroud.

According to another aspect of the invention, there is provided a method of making a double-ended arc discharge lamp. The method comprises the steps of positioning a tubular light-transmissive shroud within a light-transmissive outer jacket, attaching the ends of the shroud to the outer jacket to form an envelope assembly, positioning an arc discharge tube within the envelope assembly, and sealing the envelope assembly. In a preferred embodiment, a shroud having outwardly flared ends for spacing the shroud from the outer jacket and for supporting the shroud within the outer jacket is positioned within the outer jacket, and the flared ends of the shroud are attached to the outer jacket.

BRIEF DESCRIPTION OF THE DRAWINGS

For better understanding of the present invention, together with other and further objects, advantages and capabilities thereof, reference is made to the accompanying drawings which are incorporated herein by reference and in which.

DETAILED DESCRIPTION OF THE INVENTION

Figure 1:
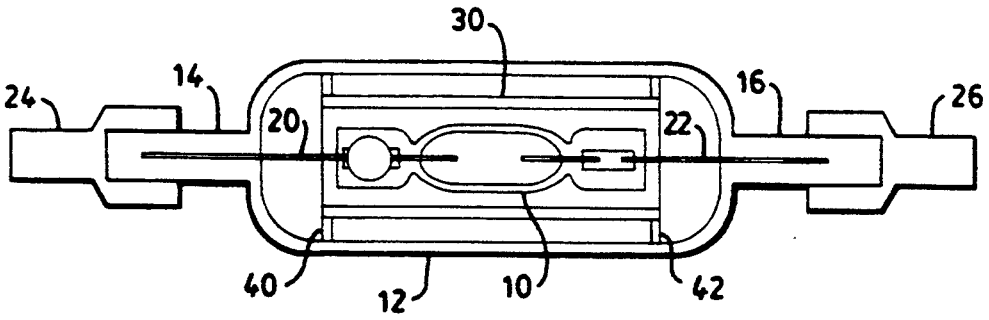
FIG. 1 is a plan view of a double-ended metal halide arc discharge lamp in accordance with the present invention.
Figure 2:
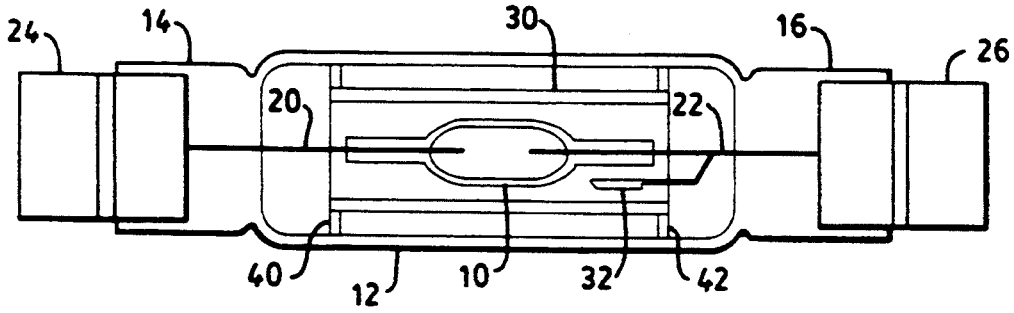
FIG. 2 is an elevation view of the arc discharge lamp of FIG. 1.

A double-ended metal halide arc discharge lamp in accordance with the present invention is shown in FIGS. 1 and 2. An arc tube 10 is sealed within an outer jacket 12. The outer jacket 12 is hermetically sealed by press seals 14 and 16 at opposite ends. Press sealing techniques are well known in the art. Electrical leads 20 and 22 extend from opposite ends of arc tube 10 through press seals 14 and 16 to external electrical contacts 24 and 26, respectively. A light-transmissive shroud 30 is located between the arc tube 10 and outer jacket 12. A getter 32 is attached to electrical lead 22.

The arc tube 10 can be a metal halide arc discharge tube, a tungsten halogen lamp capsule, or any other lamp capsule that is advantageously utilized in a double-ended configuration with a shroud. When the arc tube is a metal halide arc tube, a quartz arc tube has electrodes mounted within and contains a fill material including mercury, metal halide additives and a rare gas to facilitate starting. The electrodes are electrically connected through press seals to leads 20 and 22. Techniques for making metal halide arc tubes are well known in the art.

The outer jacket 12 is preferably light-transmissive quartz and has a tubular shape, except in the regions of press seals 14 and 16. The shroud 30 is typically a cylindrical quartz tube and is supported at its ends by the outer jacket 12. Preferably, the shroud 30 has a wall thickness in a range of about 0.75 mm to 1.5 mm. In the embodiment of FIGS. 1 and 2, the shroud 30 includes outwardly flared ends 40 and 42. The flared ends 40 and 42 are attached to the inner surface of outer jacket 12. Thus, the shroud 30 is supported directly by outer jacket 12 and is centered within and spaced from outer jacket 12.

The shroud 30 surrounds the arc tube 10 and functions as a containment means to minimize the risk of breakage of the outer jacket 12 upon rupture of the arc tube 10, which operates at positive pressures. The shroud 30 also acts as an infrared radiation shield, thereby reducing heat loss and improving operating efficiency. In addition, the shroud redistributes heat returned to the arc tube to obtain a more uniform wall temperature distribution, thereby allowing a higher cold spot temperature and improving the spectral characteristics of the lamp. Such shrouds are further known to retain an electrical charge, when suitably electrically isolated, to retard sodium loss from arc tube 10 and to improve color constancy and voltage rise over lamp life. The shroud 30 in the lamp of FIGS. 1 and 2 is electrically isolated from any of the electrical components of the lamp.

Figure 3:
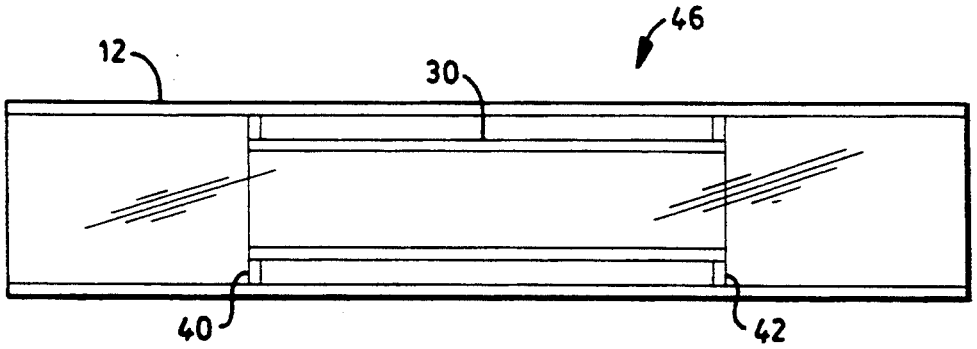
FIG. 3 is a plan view of a lamp envelope assembly including an outer jacket and a shroud.

The shroud 30 is made by flaring the ends of a cut quartz tube to the inside diameter of the outer jacket 12. The flared ends 40 and 42 are formed by heating the ends of the quartz tube and shaping them to the proper diameter. The outer diameters of the flared ends 40 and 42 are equal to or slightly less than the inside diameter of the outer jacket 12 and are concentric with the axis of shroud 30. The shroud 30 with flared ends 40 and 42 is slid into the tubular outer jacket 12 and is fixed in a desired position by fusing flared ends 40 and 42 to outer jacket 12. As shown in FIG. 3, the outer jacket 12 and the shroud 30 form a lamp envelope assembly 46. The arc tube 10 is then sealed within the lamp envelope assembly 46 using conventional press-sealing techniques to obtain a finished lamp as shown in FIGS. 1 and 2.

Figure 4:
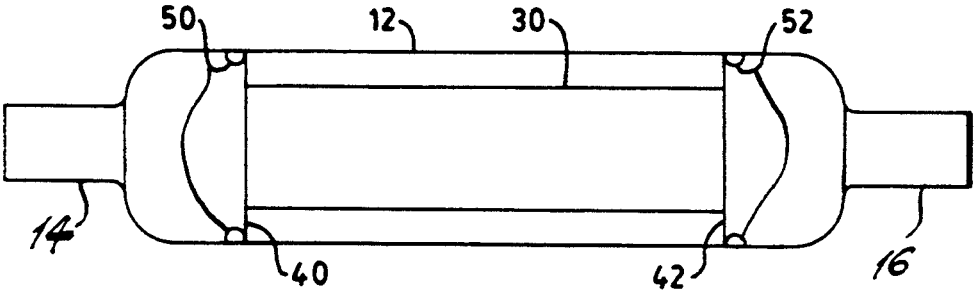
FIG. 4 is a schematic diagram of a double-ended arc discharge lamp wherein the outer jacket is provided with locating dimples, with the arc tube omitted for simplicity.

A simplified schematic diagram of an alternate or additional technique for locating the shroud within the outer jacket 12 is shown in FIG. 4. The arc tube is omitted from FIG. 4. The outer jacket 12 is provided with inwardly-extending dimples 50 and 52 which retain flared ends 40 and 42, respectively, thereby locating the shroud 30 with respect to outer jacket 12. The dimples are located adjacent to each end of the shroud 30. The dimples 50 and 52 can be used as an alternative to, or in addition to, fusing of flared ends 40 and 42 to outer jacket 12.

Figure 5:
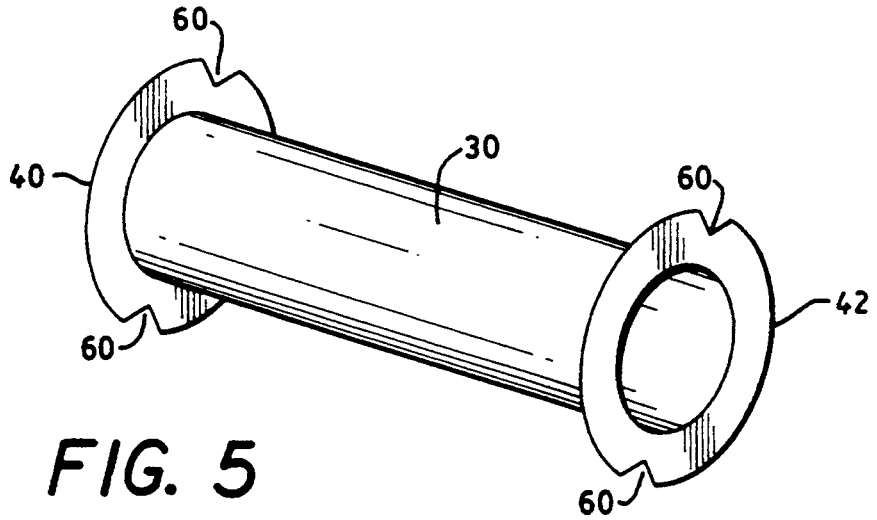
FIG. 5 is a perspective view of a shroud having flared ends provided with notches.

A preferred embodiment of the shroud 30 is shown in FIG. 5. As noted above, flared ends 40 and 42 extend outwardly from the cylindrical portion of shroud 30 and have outside diameters that are equal to or slightly less than the inside diameter of outer jacket 12. The difference between the outside diameter of the cylindrical portion of shroud 30 and the outside diameter of-flared ends 40 and establishes a spacing between shroud 30 and outer jacket 12.

The flared ends 40 and 42 are preferably provided with notches 60. When the shroud 30 is mounted within outer jacket 12, the notches 60 define passages that interconnect the interior of shroud 30 to an annular space between the shroud and outer jacket 12. The passages defined by notches 60 permit gas or liquid to flow into and out of the space between the shroud 30 and the outer jacket 12. During assembly, a cleaning fluid can be circulated through the annular space between shroud 30 and outer jacket 12 to remove smoke and other contaminants that were deposited during the assembly process. During operation of the lamp, the passages defined by notches 60 ensure that the pressure is equalized on the inside and outside surfaces of shroud 30.

Figure 6:
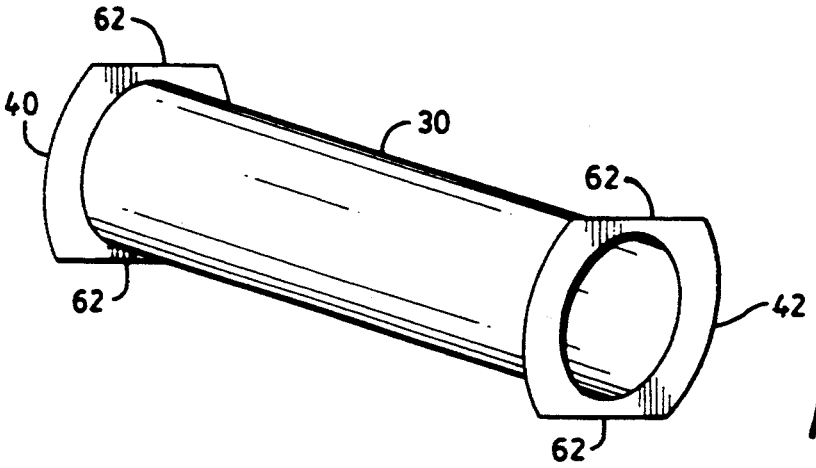
FIG. 6 is a perspective view of a shroud having flared ends with cutaway portions.

An alternate embodiment of the shroud 30 is shown in FIG. 6. The flared ends 40 and 42 are provided with cutaway portions 62. When the shroud 30 is mounted in the outer jacket 12, the cutaway portions 62 define passages for access to the annular space between shroud 30 and outer jacket 12.

In one example of a double-ended metal halide arc discharge lamp in accordance with the present invention, the outer jacket had an outside diameter of 25 mm, an inside diameter of 22 mm and an overall length of 4.25 inches. The shroud had an outside diameter of 20 mm, an inside diameter of 18 mm and a length of 45 mm. The shroud and the outer jacket were fabricated of quartz. A metal halide arc tube rated at 150 watts was used.

In a second example, the outer jacket had an outside diameter of 20 mm, an inside diameter of 18 mm and an overall length of 4.2 inches. The shroud had an outside diameter of 14 mm, an inside diameter of 12 mm and a length of 35 mm. A metal halide arc tube rated at 40 watts was used.

Figure 7:
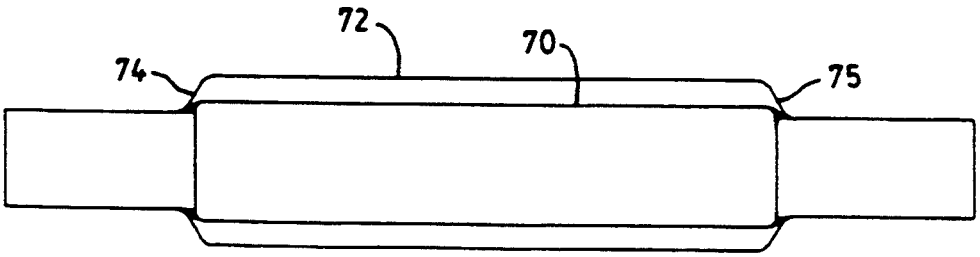
FIG. 7 is a schematic diagram of an alternate embodiment of the invention, with the arc tube omitted for simplicity.

A schematic diagram of an alternate embodiment of the present invention is shown in FIG. 7. In the embodiment of FIG. 7, a cylindrical shroud 70 is mounted within an outer jacket 72. The arc tube is omitted from FIG. 7 for simplicity. The shroud 70 does not include flared ends as described above. Instead, the outer jacket 72 is reduced in diameter at regions 74 and 75 near its ends and is attached to the respective ends of shroud 70, typically by fusing. The embodiment shown in FIG. 7 produces relatively thick quartz in the regions where the outer jacket 72 is fused to shroud 70 and makes press sealing of the outer jacket 72 somewhat more difficult. However, assuming that the outer jacket can be sealed satisfactorily, the configuration of FIG. 7 is acceptable.

The double-ended arc discharge lamp structure shown and described herein permits mounting of a shroud that is electrically isolated from the leads of the lamp and is mounted without the use of metal clamps and frames. The-outer jacket is protected by the shroud in the event that the arc tube ruptures. Since the shroud is electrically isolated, the effect on sodium loss is minimized. The disclosed lamp configuration provides containment strength, shock and vibration resistance, compact physical dimensions and the ability to withstand high operating temperatures.

While there have been shown and described what are at present considered the preferred embodiments of the present invention, it will be obvious to those skilled in the art that various changes and modifications may be made therein without departing from the scope of the invention as defined by the appended claims.

I claim:

1. A method of making a double ended arc discharge lamp comprising the steps of:

forming a hollow, light transmissive outer jacket;

forming a hollow, light transmissive shroud of a given material having a pair of annuli, one annulus being formed at each end of said shroud, said annuli being formed of said given material;

positioning said shroud within said outer jacket;

attaching the peripheral edge of each of said annuli to said jacket to form an envelope assembly;

positioning an arc discharge tube within said envelope assembly; and sealing said envelope assembly.

2. The method of claim 1 wherein said annuli are formed by flaring the ends of said shroud.

* * * * *